US011891674B2

(12) United States Patent
Lian et al.

(10) Patent No.: US 11,891,674 B2
(45) Date of Patent: Feb. 6, 2024

(54) HIGH-STRENGTH MULTIPHASE TINNED STEEL RAW PLATE AND MANUFACTURING METHOD THEREFOR

(71) Applicant: BAOSHAN IRON & STEEL CO., LTD., Shanghai (CN)

(72) Inventors: Fuliang Lian, Shanghai (CN); Gaofei Liang, Shanghai (CN); Hongxing Chen, Shanghai (CN); Shunli Zhao, Shanghai (CN); Bijun Ban, Shanghai (CN); Xiujun Li, Shanghai (CN); Gang Xu, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 110 days.

(21) Appl. No.: 16/642,433

(22) PCT Filed: Aug. 28, 2018

(86) PCT No.: PCT/CN2018/102619

§ 371 (c)(1),
(2) Date: Feb. 27, 2020

(87) PCT Pub. No.: WO2019/042268

PCT Pub. Date: Mar. 7, 2019

(65) Prior Publication Data

US 2020/0255915 A1 Aug. 13, 2020

(30) Foreign Application Priority Data

Aug. 30, 2017 (CN) ..... 201710761690.6

(51) Int. Cl.

| | |
|---|---|
| ***C22C 38/04*** | (2006.01) |
| ***C21D 8/02*** | (2006.01) |
| ***C21D 1/26*** | (2006.01) |
| ***C21D 6/00*** | (2006.01) |
| ***C22C 38/00*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 8/0247* (2013.01); *C21D 1/26* (2013.01); *C21D 6/002* (2013.01); *C21D 6/005* (2013.01); *C21D 6/008* (2013.01); *C21D 8/0205* (2013.01); *C21D 8/0236* (2013.01); *C22C 38/001* (2013.01); *C22C 38/002* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C21D 2211/003* (2013.01); *C21D 2211/005* (2013.01); *C21D 2211/008* (2013.01); *C21D 2211/009* (2013.01)

(58) Field of Classification Search

CPC ..... C21D 2211/005

See application file for complete search history.

(56) References Cited

U.S. PATENT DOCUMENTS

| | | | | |
|---|---|---|---|---|
| 2011/0318606 | A1* | 12/2011 | Fujimoto | C23C 2/02 428/659 |
| 2014/0332123 | A1* | 11/2014 | Nakagawa | C22C 38/06 148/645 |
| 2015/0010779 | A1 | 1/2015 | Szesni et al. | |

FOREIGN PATENT DOCUMENTS

| | | | | |
|---|---|---|---|---|
| CN | 102286688 | | 12/2011 | |
| CN | 102719738 | | 10/2012 | |
| RU | 2575062 | C1 | 10/2016 | |
| RU | 2586196 | C2 | 10/2016 | |
| WO | 2008102006 | | 8/2008 | |
| WO | WO-2013094130 | A1 * | 6/2013 | C22C 38/02 |

OTHER PUBLICATIONS

International Search Report and Written Opinion dated Nov. 14, 2018 for PCT Patent Application PCT/CN2018/102619.
Russian Search Report dated Sep. 23, 2021.
OA from Russian IP Office dated Sep. 23, 2021.

* cited by examiner

*Primary Examiner* — Jophy S. Koshy
(74) *Attorney, Agent, or Firm* — Lei Fang, Esq.; Smith Tempel Blaha LLC

(57) ABSTRACT

Disclosed are a high-strength multiphase steel tinned raw plate and a manufacturing method therefor, wherein the mass percentages of the components of the multiphase steel tinned raw plate are: 0.081%-0.14% of C, 0.2%-0.8% of Mn, 0.01%-0.09% of Al, 0.01%-0.03% of P, 0.002%-0.015% of N, also containing one or more than one of 0.001%-0.005% of B, 0.005%-0.05% of Cr, 0.001%-0.1% of Ti, 0.001%-0.2% of Nb, 0.005%-0.03% of Cu, 0.001%-0.008% of Mo, and the balance of Fe and other inevitable impurities; and satisfy: 0.21%≤Mn+1.3 Cr+3.2 Mo+0.5 Cu≤0.91%. The tinned raw plate has a structure comprising ferrite grains, pearlite, martensite and cementite particles, wherein the total volume fraction of the pearlite, martensite and cementite particles is 5%-20%, the volume fraction of the martensite is 1%-5%, and the martensite has a solid solution content of carbon of ≥0.07%. The tinned raw plate has a high strength and better elongation, and can be used to produce a can body, a can bottom, an easy-open end and a twist-off cap, etc. of a three-piece can which has higher requirements for strength and elongation.

12 Claims, 1 Drawing Sheet

HIGH-STRENGTH MULTIPHASE TINNED STEEL RAW PLATE AND MANUFACTURING METHOD THEREFOR

CROSS-REFERENCE TO RELATED APPLICATIONS

This application is a 371 U.S. National Phase of PCT International Application No. PCT/CN2018/102619 filed on Aug. 28, 2018, which claims benefit and priority to Chinese patent application no. 201710761690.6 filed on Aug. 30, 2017. Both of the above-referenced applications are incorporated by reference herein in their entireties.

Technical Field

The present disclosure relates to a high-strength multiphase steel tinned raw plate and a manufacturing method therefor.

Background Art

A tinned steel plate is a packaging material obtained by tinning a surface of a steel plate. Owing to a combination of high strength of the steel plate and high corrosion resistance of the tin layer, the tinned steel plate is widely used for outer packages of foods, beverages, chemicals and the like, for example, two-piece or three-piece cans, barrels, easy-to-open or screwing caps, etc. In recent years, in view of the uninterrupted requirements of energy conservation, emission reduction, cost reduction, and consumption reduction, tinned plate thickness is continuously reduced. For instance, the thickness of DI materials for common beverage cans has been reduced from 0.28-0.29 mm of twenty years ago to 0.21-0.22 mm, and the thickness of tinned plates for easy-to-open caps is reduced from about 0.25 mm of single cold-rolled tinned plates to about 0.18 mm of double cold-rolled tinned plates. In order to guarantee normal use of thinned materials, higher and higher requirements are imposed on tinned plate strength.

WO2008/102006A1 discloses a method for producing a high-strength tinned raw plate, wherein the strength of the steel plate is increased by low-temperature annealing, and the elongation of the steel plate is guaranteed by selecting a steel composition having an ultra-low carbon content (5-40 ppm carbon), thereby producing a series of thin tinned raw plates having a yield strength of 500 MPa or higher at the end. However, this strip steel is an ultra-low carbon steel. Hence, the steel making process entails additional vacuum decarburization, leading to increased steel-making cost.

US Patent Application US20150010779A1 discloses a method for producing a tinned raw plate having a tensile strength of at least 500 MPa and an elongation at break of greater than 5%. The alloy composition of this steel plate is: C≤0.1%, N≤0.02%, Mn≤0.5%, Si≤0.04%, Al≤0.1%, Cr≤0.1%, P≤0.03%, Cu≤0.1%, Ni≤0.1%, Sn≤0.04%, Mo≤0.04%, V≤0.04%, Ti≤0.05%, Nb≤0.05%, B≤0.005%. By heating to 700° C. or higher at a fast heating rate (75K/s, preferably greater than 100K/s), holding for a short time of 1-2 s and cooling at a cooling rate of 100-1200K/s at a continuous annealing stage, a tinned raw plate having a tensile strength of at least 500 MPa and an elongation at break of greater than 5% may be obtained. This technique requires rapid advancement of the continuous annealing stage, wherein both the heating rate and the cooling rate are very fast. This imposes very high requirements on the facilities and the precision of operation and control. Hence, it's difficult to realize steady industrial production on a large scale.

Chinese Patent Application CN101999009A discloses a method for producing a high-strength tinned raw plate having a tensile strength of 500 MPa or higher for containers, wherein the steel composition is: C: 0.01-0.05%, Si: 0.04% or less, Mn: 0.1-1.2%, S: 0.10% or less, Al: 0.001-0.100%, N: 0.10% or less, P: 0.0020-0.100%, and a balance of Fe and unavoidable impurities. The key process of this method is a reduction rate of 20-50% in a double cold reduction stage. Although the strength of the strip steel obtained by this method is high, the high reduction rate in the double cold reduction stage results in a low elongation of the strip steel, not suitable for applications requiring certain formability.

SUMMARY

An object of the present disclosure is to provide a high-strength multiphase steel tinned raw plate and a method for manufacturing the same, wherein the properties of the steel plate after baking and the reduction rate of the double cold reduction meet the following relationships: yield strength Rp0.2≥(400+12×DCR) MPa, elongation A≥(25−1.2×DCR) %, and 5%≤DCR≤18%. The tinned raw plate has high strength and good elongation, useful for producing three-piece can bodies, can bottoms, easy-to-open caps, screwing caps and the like which have high requirements on strength and elongation.

To achieve the above object, the technical solution of the disclosure is as follows:

A high-strength multiphase steel tinned raw plate, having a chemical composition comprising, by mass percentage, C: 0.081-0.14%, Mn: 0.2-0.8%, Al: 0.01-0.09%, P: 0.01-0.03%, N: 0.002-0.015%, further comprising one or more of B: 0.001-0.005%, Cr: 0.005-0.05%, Ti: 0.001-0.1%, Nb: 0.001-0.2%, Cu: 0.005-0.03%, Mo: 0.001-0.008%, and a balance of Fe and unavoidable impurities, wherein the following relationship is met: 0.21%≤Mn+1.3Cr+3.2Mo+0.5Cu≤0.91%.

Further, the high-strength multiphase steel tinned raw plate has a structure consisting of ferrite grains, pearlite, martensite and cementite particles.

Preferably, the ferrite in the structure of the high-strength multiphase steel tinned raw plate has a grain size of ≤7 μm.

Preferably, the pearlite+martensite+cementite particles in the structure of the high-strength multiphase steel tinned raw plate have a volume fraction of 5-20%.

Preferably, the martensite in the structure of the high-strength multiphase steel tinned raw plate has a volume fraction of 1-5%.

Preferably, the martensite in the structure of the high-strength multiphase steel tinned raw plate has a carbon solid solution content of ≥0.07%.

Further, after baking, the high-strength multiphase steel tinned raw plate has a yield strength Rp0.2≥(400+12×DCR) MPa, and an elongation A≥(25-1.2×DCR) %, wherein DCR represents a reduction rate of double cold reduction, wherein 5%≤DCR≤18%.

In the compositional design of the high-strength multiphase steel tinned raw plate according to the present disclosure:

C: The carbon element is a major strengthening element in the material. In the present disclosure, carbon strengthens the strip steel in the following two ways: one is to strengthen by solid dissolution of carbon in the martensitic structure, and the other one is to strengthen by precipitation of carbon in the form of pearlite sheets or cementite particles. To guarantee the effect of strengthening the strip steel, carbon should be added into the steel plate in an amount of ≥0.081%. An unduly high amount of carbon tends to precipitate at ferrite grain boundaries in the course of annealing, thereby degrading the plasticity of the steel plate, and negatively affecting the final processing property, welding property, isotropy, particularly properties after baking and heating of the material. Therefore, the carbon content in the steel according to the present disclosure is controlled at 0.081-0.14%.

Mn: The main function of the manganese element, similar to that of the carbon element in the present disclosure, is to further increase the strength of the steel plate by solid dissolution of manganese. In addition, the manganese element and the sulfur in the steel form MnS, thereby eliminating the hot shortness problem of the steel caused by sulfur, so as to improve the hot working performance of the steel. However, an unduly high amount of manganese tends to cause segregation of manganese in a cast slab and a notable distribution of a banded structure in a hot rolled plate, undesirable for the stamping performance of a final thin plate, particularly in the case where local deformation of a steel strip is large (for example, in a riveting process for producing easy-to-open caps), because the segregation of manganese tends to cause local cracking. Therefore, the manganese content in the steel according to the present disclosure is controlled at 0.2-0.8%.

Al: The aluminum element mainly functions to remove oxygen from the steel and may also refine grains. The nitrogen element and the aluminum element in the steel form AlN which precipitates, thereby eliminating the influence of the nitrogen element on the aging of a thin strip in the course of baking and heating. Addition of an excessive amount of aluminum tends to reduce the castability of a slab. Therefore, the aluminum content suitable for the steel of the present disclosure is controlled at 0.01-0.09%.

P: The phosphorus element, which is also a solid solution strengthening element, can improve the strength of the steel. However, an unduly high amount of phosphorus will increase the cold shortness and plasticity of a steel plate and decrease the cold bendability and weldability of the steel. Therefore, the phosphorus content according to the present disclosure is controlled at 0.01-0.03%.

N: Solid dissolution of the nitrogen element can increase the strength of the steel greatly. However, an unduly high amount of nitrogen will degrade the baking aging resistance of a thin strip. In addition, the isotropy will be affected too. Therefore, the nitrogen content in the thin steel plate according to the present disclosure is controlled at 0.002-0.015%.

In order to obtain a room temperature martensitic phase structure, generation of a certain amount of martensitic phase should be guaranteed in the annealing of the steel plate. For this purpose, the proportions of Mn, Cr, Mo, Cu and other alloy elements are critical. In the present disclosure, the proportions of these alloy elements are controlled to meet 0.21%≤Mn+1.3Cr+3.2Mo+0.5Cu≤0.91%. If the sum is lower than 0.21%, the martensite content will be too low to impart sufficient performances to the steel plate. If the sum is higher than 0.91%, it will be difficult to manufacture the steel plate because the process window of double cold reduction should be narrowed to ensure a desired product of strength and elongation of the steel plate. Besides, addition of the boron element can improve the baking aging resistance of the thin steel strip and reduce loss of elongation after baking the steel plate. Addition of the titanium and niobium elements can influence the austenite grain size in annealing, and further influence the structural morphology and mechanical performances of the multiphase steel at room temperature. Therefore, the contents of Mn, Cr, Mo, Cu, B, Ti, Nb and other elements may be adjusted and controlled as described above in view of the specific requirements of the strength and elongation after baking and aging in practical applications.

The high-strength multiphase steel tinned raw plate according to the present disclosure requires such an ultimate structural feature that the structure is consisting of ferrite grains, pearlite, martensite and cementite particles, wherein the ferrite has a grain size of ≤7 μm in a direction perpendicular to a rolling direction; the pearlite, martensite and cementite particles in the strip steel structure account for 5-20% of the structure by volume; the martensite in the strip steel structure accounts for 1-5% of the structure by volume; and the martensite in the strip steel has a carbon solid solution content of ≥0.07%.

Ferrite in a steel plate structure is the most typical structure in common cold-rolled steel. In the present disclosure, the grain size of ferrite in the tinned raw plate is controlled to be ≤7 μm. As such, the strength of the ferrite matrix is ensured by fine grain strengthening. Nevertheless, the high strength requirement cannot be satisfied by refining the ferrite grains alone. Hence, three strengthening phases of pearlite, martensite and cementite particles are also present in the tinned raw plate structure according to the present disclosure, wherein pearlite and martensite are the major strengthening phases, which are converted from austenite by cooling during annealing, wherein austenite itself is formed by heating. Pearlite is consisting of ferrite bands and cementite bands, generally formed at high temperatures during cooling. Martensite is a super-solid solution of ferrite, which is generally formed at low temperatures during cooling, and has the largest effect in strengthening steel.

In order to ensure the strengthening effect of pearlite and martensite, the present disclosure requires that the pearlite, martensite and cementite particles in the structure should account for 5% or more based on the total volume of the structure. Due to the poor plasticity of pearlite and martensite, excessive pearlite and martensite will reduce the elongation of a thin strip steel. Therefore, the total volume fraction of the pearlite, martensite and cementite particles in the high-strength multiphase steel tinned raw plate is 20% or less.

In addition, to ensure strengthening the strip steel, martensite in the strip steel structure according to the present disclosure is required to be 1% or more. To avoid the negative influence of excessive martensite on the plasticity of the strip steel, the martensite structure should be controlled at 5% or less. Meanwhile, to ensure the strengthening effect of martensite on the strip steel, the carbon solid solution content in martensite in the strip steel according to the present disclosure is 0.07% or more.

A method for manufacturing the high-strength multiphase steel tinned raw plate according to the present disclosure, wherein the tinned raw plate has a chemical composition comprising, by mass percentage, C: 0.081-0.14%, Mn: 0.2-0.8%, Al: 0.01-0.09%, P: 0.01-0.03%, N: 0.002-0.015%, further comprising one or more of B: 0.001-0.005%, Cr: 0.005-0.05%, Ti: 0.001-0.1%, Nb: 0.001-0.2%, Cu: 0.005-0.03%, Mo: 0.001-0.008%, and a balance of Fe and unavoidable impurities, wherein the following relationship is met: 0.21%≤Mn+1.3Cr+3.2Mo+0.5Cu≤0.91%, wherein the tinned raw plate is subjected to continuous annealing and double cold reduction in sequence, wherein a temperature T in the continuous annealing stage is (727-100×C−30×Mn-1000×N)° C.≤T≤800° C.; a hold time is 30 s-50 s; a cooling rate in a zone having a temperature of 250° C. or higher is 50-90° C./s; wherein a reduction rate of the double cold reduction DCR is 5%≤DCR≤18%.

Further, production steps prior to the continuous annealing of the tinned raw plate include smelting, hot rolling, pickling and single cold reduction.

To ensure generation of pearlite and martensite in the final structure of the multiphase steel tinned raw plate, the temperature in the heating stage of the annealing process for the strip steel should be controlled to be higher than the austenite transformation temperature. C, Mn and N, as the main elements in the steel, may all influence the austenization temperature. Therefore, the continuous annealing temperature T of the strip steel according to the present disclosure is ≥(727−100×C−30×Mn−1000×N)° C. However, an unduly high annealing temperature will lead to sharp growth of the strip steel grains, thereby reducing the strength of the strip steel. Therefore, the annealing temperature T is ≤800° C. Thus, the annealing temperature T is controlled at (727−100×C−30×Mn−1000×N)° C.≤T≤800° C. in the continuous annealing stage according to the disclosure.

To ensure complete austenization in the annealing process of the strip steel, the hold time should be ≥30 s. The longer the hold time in the annealing, the severer the growth of the strip steel grains. Therefore, with the proviso that austenization of the strip steel is ensured, the hold time is ≤50 s. Thus, the hold time is controlled at 30 s-50 s in the continuous annealing stage according to the present disclosure.

According to the present disclosure, the annealing rate dictates the amounts of pearlite and martensite, the spacing between pearlite bands, and the carbon solid solution content in martensite. To ensure the optimal structure of the strip steel, the cooling rate in the zone having a temperature of 250° C. or higher should be ≥50° C./s. If the cooling rate is too low, pearlite transformation will be more complete, and no martensite will form. In addition, the spacing between the resulting pearlite bands will be large, and the strength of the strip steel will be lowered. It's also required that the cooling rate in the zone having a temperature of 250° C. or higher should be ≤90° C./s. If the cooling rate is too high, the pearlite transformation will be inhibited, such that there will be excessive martensite in the structure. Although the strength of the strip steel will be increased, a big loss will be caused to the elongation of the strip steel. Therefore, the cooling rate in the zone having a temperature of 250° C. or higher in the continuous annealing stage according to the present disclosure is controlled at 50-90° C./s.

After the continuous annealing, the high-strength multiphase steel tinned raw plate according to the present disclosure is subjected to double cold reduction. The main function of the double cold reduction is to further thin the strip steel, and further increase the strength of the strip steel. Nevertheless, the elongation of the strip steel will be decreased at the same time. Therefore, the reduction rate of the double cold reduction DCR should be ≤18% according to the present disclosure.

Based on the above chemical composition, structure and manufacturing method, after baking at 150-300° C. for 15-60 min, the high-strength multiphase steel tinned raw plate provided according to the present disclosure has a yield strength Rp0.2≥(400+12×DCR)MPa, and an elongation A≥(25−1.2×DCR) %, wherein DCR represents a reduction rate of double cold reduction, wherein 5%≤DCR≤18%.

The beneficial effects of the disclosure include:

The carbon content and the manganese equivalent are increased in the alloy composition of the high-strength multiphase steel tinned raw plate according to the present disclosure. As compared with ultra-low carbon steel, this compositional system allows for omission of a vacuum decarburization process in steel making, thereby reducing the steel making cost.

As compared with a rapid continuous annealing process, the annealing temperature in the continuous annealing process according to the present disclosure is controlled more precisely, and the cooling rate is low. This process has lower requirements on the facilities and the precision of operation and control. Hence, it can control plate shape and produce wide tinned raw plates more easily. In addition, it's easier to realize steady industrial production on a large scale.

The high-strength multiphase steel tinned raw plate according to the present disclosure can be subjected to double cold reduction. As compared with a single cold reduction process, the double cold reduction process is desirable for further thinning of the strip steel. As compared with a strip steel obtained at a larger double cold reduction rate, the strip steel obtained according to the present disclosure still maintains a high elongation A≥(25−1.2×DCR) % after baking, wherein DCR represents the reduction rate of double cold reduction, wherein 5%≤DCR≤18%.

DETAILED DESCRIPTION

Figure 1:
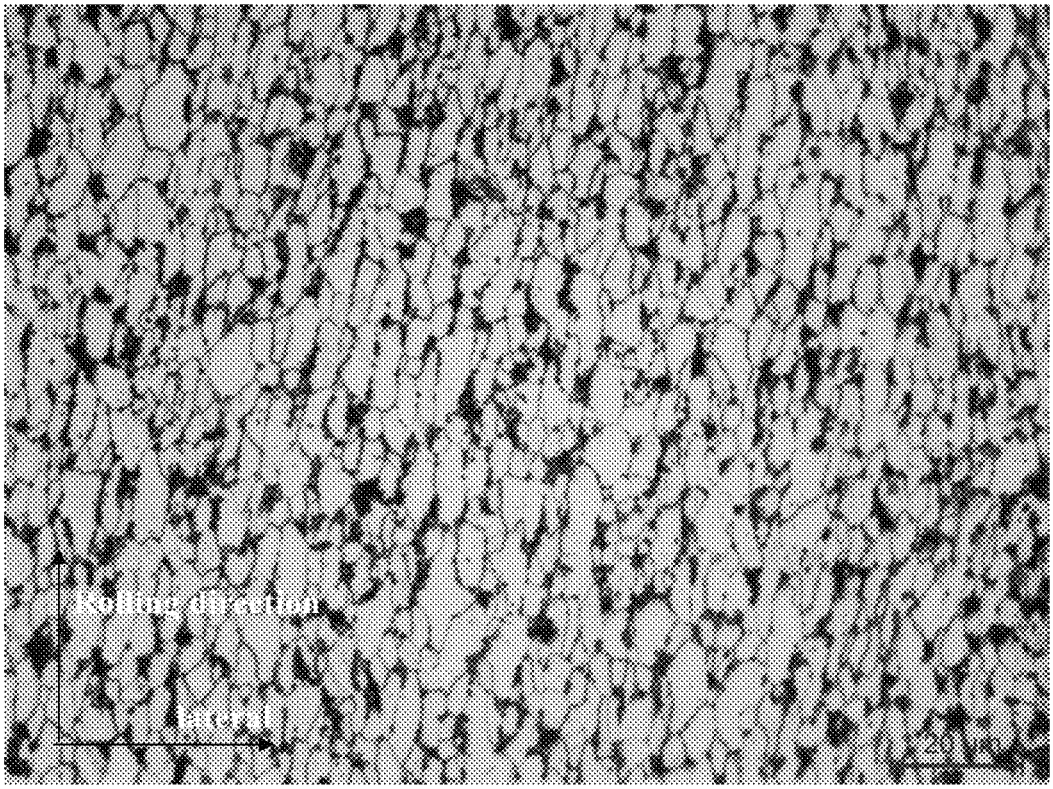
FIG. 1 is a photograph of the metallographical structure of the steel plate of Example 1 according to the present disclosure.

The disclosure will be further illustrated with reference to the following Examples and accompanying drawings.

Table 1 lists the alloy compositions of the Examples and Comparative Examples in the present disclosure. Table 2 shows the features of the main process stages and the features of the phase compositions of the Examples and Comparative Examples in the present disclosure. Table 3 shows the yield strength and elongation properties of the Examples and Comparative Examples after baking (baking temperature 200° C.; baking time 30 min).

EXAMPLE 1

The alloy composition of Example 1 is shown in Table 1: C: 0.081%, Mn: 0.5%, Al: 0.05%, P: 0.015%, N: 0.005%, B: 0.001%, Cr: 0.02%, Cu: 0.01%, Mo: 0.001%. The features of the phase composition and the production process for the strip steel are shown in Table 2: the zone of pearlite+martensite+cementite particles accounted for 10% by volume; the martensite zone accounted for 2% by volume; the grain size of ferrite was 6.5 μm; and the carbon solid solution content in martensite was 0.082%. The temperature at the continuous annealing stage for the strip steel was 720° C.; the hold time at the annealing stage was 40 s; the cooling rate in the annealing was 60° C./s; and the reduction rate of the double cold reduction for the strip steel was 10%. The mechanical performances of the final strip steel baked at 200° C. for 30 min are shown in Table 3: the yield strength Rp0.2 was 564 MPa; and the elongation at break was 18%.

Figure 2:
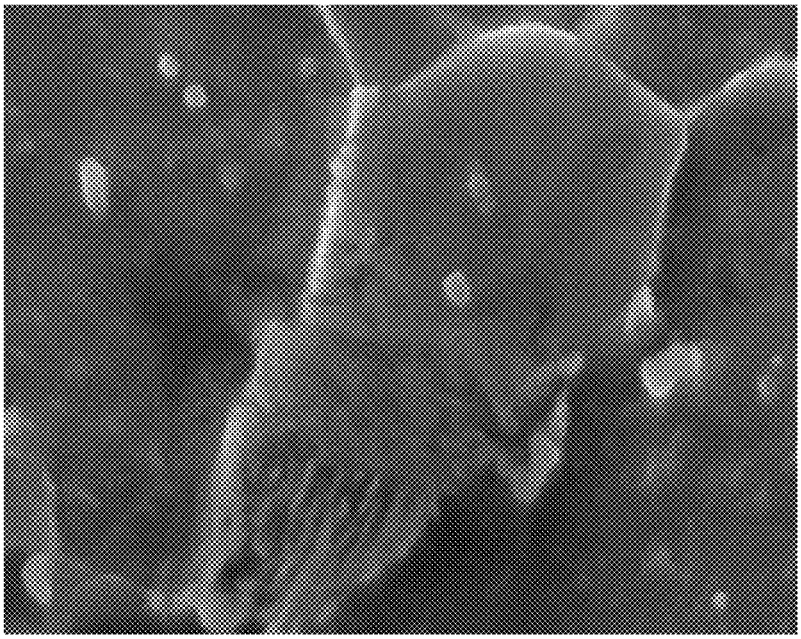
FIG. 2 is a photograph showing the topography of the pearlite+martensite+cementite particles in the metallographical structure of the steel plate of Example 1 according to the present disclosure.

As known from FIGS. 1 and 2, the structure of the tinned raw plate in this Example was consisting of ferrite grains, pearlite, martensite and cementite particles, wherein the zone of pearlite+martensite+cementite accounted for 10% by volume; the martensite zone accounted for 2% by volume; the grain size of ferrite was 6.5 μm (the grain size of ferrite was measured from the metallographical structure shown by FIG. 1 in the transverse direction using the linear intercept method); and the carbon solid solution content in martensite was 0.082%.

EXAMPLE 2

The alloy composition of Example 2 was: C: 0.081%, Mn: 0.5%, Al: 0.05%, P: 0.01%, N: 0.005%, B: 0.003%, Cr: 0.05%, Ti: 0.005%, Nb: 0.2%, Cu: 0.01%, Mo: 0.005%. The features of the phase composition of the strip steel were: the zone of pearlite+martensite+cementite particles accounted for 13% by volume; the martensite zone accounted for 4% by volume; the grain size of ferrite was 6.5 μm; and the carbon solid solution content in martensite was 0.095%. The temperature at the continuous annealing stage for the strip steel was 750° C.; the hold time at the annealing stage was 40 s; the cooling rate in the annealing was 90° C./s; and the reduction rate of the double cold reduction for the strip steel was 5%. The mechanical performances of the final strip steel baked at 200° C. for 30 min: the yield strength Rp0.2 was 512 MPa; and the elongation at break was 20.9%.

EXAMPLE 3

The alloy composition of Example 3 was: C: 0.135%, Mn: 0.2%, Al: 0.05%, P: 0.01%, N: 0.005%, B: 0.003%, Cr: 0.005%, Cu: 0.03%, Mo: 0.005%. The features of the phase composition of the strip steel were: the zone of pearlite+martensite+cementite particles accounted for 5% by volume; the martensite zone accounted for 1.2% by volume; the grain size of ferrite was 5.3 μm; and the carbon solid solution content in martensite was 0.071%. The temperature at the continuous annealing stage for the strip steel was 705° C.; the hold time at the annealing stage was 30 s; the cooling rate in the annealing was 50° C./s; and the reduction rate of the double cold reduction for the strip steel was 5%. The mechanical performances of the final strip steel baked at 200° C. for 30 min: the yield strength Rp0.2 was 482 MPa; and the elongation at break was 20.2%.

EXAMPLE 4

The alloy composition of Example 4 was: C: 0.14%, Mn: 0.5%, Al: 0.01%, P: 0.015%, N: 0.015%, B: 0.003%, Cr: 0.02%, Ti: 0.1%, Cu: 0.01%, Mo: 0.008%. The features of the phase composition of the strip steel were: the zone of pearlite+martensite+cementite particles accounted for 19% by volume; the martensite zone accounted for 4.8% by volume; the grain size of ferrite was 6.2 μm; and the carbon solid solution content in martensite was 0.1%. The temperature at the continuous annealing stage for the strip steel was 800° C.; the hold time at the annealing stage was 30 s; the cooling rate in the annealing was 90° C./s; and the reduction rate of the double cold reduction for the strip steel was 18%. The mechanical performances of the final strip steel baked at 200° C. for 30 min: the yield strength Rp0.2 was 650 MPa; and the elongation at break was 5.5%.

EXAMPLE 5

The alloy composition of Example 5 was: C: 0.1%, Mn: 0.8%, Al: 0.035%, P: 0.015%, N: 0.015%, B: 0.005%, Cr: 0.02%, Ti: 0.001%, Cu: 0.01%. The features of the phase composition of the strip steel were: the zone of pearlite+martensite+cementite particles accounted for 14% by volume; the martensite zone accounted for 1.5% by volume; the grain size of ferrite was 6.8 μm; and the carbon solid solution content in martensite was 0.081%. The temperature at the continuous annealing stage for the strip steel was 750° C.; the hold time at the annealing stage was 50 s; the cooling rate in the annealing was 50° C./s; and the reduction rate of the double cold reduction for the strip steel was 10%. The mechanical performances of the final strip steel baked at 200° C. for 30 min: the yield strength Rp0.2 was 544 MPa; and the elongation at break was 15%.

EXAMPLE 6

The alloy composition of Example 6 was: C: 0.1%, Mn: 0.5%, Al: 0.09%, P: 0.03%, N: 0.005%, B: 0.003%, Cr: 0.02%, Ti: 0.005%, Nb: 0.001, Cu: 0.005%. The features of the phase composition of the strip steel were: the zone of pearlite+martensite+cementite particles accounted for 5% by volume; the martensite zone accounted for 2.5% by volume; the grain size of ferrite was 5.5 μm; and the carbon solid solution content in martensite was 0.09%. The temperature at the continuous annealing stage for the strip steel was 700° C.; the hold time at the annealing stage was 30 s; the cooling rate in the annealing was 90° C./s; and the reduction rate of the double cold reduction for the strip steel was 12%. The mechanical performances of the final strip steel baked at 200° C. for 30 min: the yield strength Rp0.2 was 597 MPa; and the elongation at break was 13%.

EXAMPLE 7

The alloy composition of Example 7 was: C: 0.1%, Mn: 0.5%, Al: 0.09%, P: 0.03%, N: 0.002%, B: 0.003%, Cr: 0.02%, Ti: 0.005%, Cu; 0.01%. The features of the phase composition of the strip steel were: the zone of pearlite+martensite+cementite particles accounted for 14% by volume; the martensite zone accounted for 3.5% by volume; the grain size of ferrite was 6.2 μm; and the carbon solid solution content in martensite was 0.089%. The temperature at the continuous annealing stage for the strip steel was 750° C.; the hold time at the annealing stage was 40 s; the cooling rate in the annealing was 80° C./s; and the reduction rate of the double cold reduction for the strip steel was 10%. The mechanical performances of the final strip steel baked at 200° C. for 30 min: the yield strength Rp0.2 was 575 MPa; and the elongation at break was 17%.

EXAMPLE 8

The alloy composition of Example 8 was: C: 0.1%, Mn: 0.5%, Al: 0.05%, P: 0.015%, N: 0.005%, B: 0.003%, Cr: 0.02%, Ti: 0.005%, Cu: 0.01%. The features of the phase composition of the strip steel were: the zone of pearlite+martensite+cementite particles accounted for 19% by volume; the martensite zone accounted for 1.2% by volume; the grain size of ferrite was 6.7 μm; and the carbon solid solution content in martensite was 0.080%. The temperature at the continuous annealing stage for the strip steel was 800° C.; the hold time at the annealing stage was 30 s; the cooling rate in the annealing was 50° C./s; and the reduction rate of the double cold reduction for the strip steel was 5%. The mechanical performances of the final strip steel baked at 200° C. for 30 min: the yield strength Rp0.2 was 497 MPa; and the elongation at break was 20.3%.

COMPARATIVE EXAMPLE 1

The alloy composition of Comparative Example 1 was: C: 0.07%, Mn: 0.5%, Al: 0.09%, P: 0.03%, N: 0.002%, B: 0.003%, Cr: 0.02%, Ti: 0.005%, Cu: 0.04%. The features of the phase composition of the strip steel were: no pearlite+martensite zone; the grain size of ferrite was 5.2 μm. The temperature at the continuous annealing stage for the strip steel was 690° C.; the hold time at the annealing stage was 40 s; the cooling rate in the annealing was 50° C./s; and the reduction rate of the double cold reduction for the strip steel was 19%. The mechanical performances of the final strip steel baked at 200° C. for 30 min: the yield strength Rp0.2 was 645 MPa; and the elongation at break was 0.5%.

COMPARATIVE EXAMPLE 2

The alloy composition of Comparative Example 2 was: C: 0.1%, Mn: 0.1%, Al: 0.05%, P: 0.008%, N: 0.005%, B: 0.01%, Cr: 0.02%, Ti: 0.005%, Cu: 0.01%. The features of the phase composition of the strip steel were: the zone of pearlite+martensite+cementite particles accounted for 12% by volume; the martensite zone accounted for 3.2% by volume; the grain size of ferrite was 8.2 μm; and the carbon solid solution content in martensite was 0.068%. The temperature at the continuous annealing stage for the strip steel was 750° C.; the hold time at the annealing stage was 60 s; the cooling rate in the annealing was 50° C./s; and the reduction rate of the double cold reduction for the strip steel was 10%. The mechanical performances of the final strip steel baked at 200° C. for 30 min: the yield strength Rp0.2 was 501.3 MPa; and the elongation at break was 8%.

COMPARATIVE EXAMPLE 3

The alloy composition of Comparative Example 3 was: C: 0.1%, Mn: 0.5%, Al: 0.005%, P: 0.05%, N: 0.002%, B: 0.003%, Cr: 0.02%, Ti: 0.005%, Cu: 0.01%, Mo: 0.01%. The features of the phase composition of the strip steel were: the zone of pearlite+martensite+cementite particles accounted for 14% by volume; the martensite zone accounted for 7.8% by volume; the grain size of ferrite was 5.7 μm; and the carbon solid solution content in martensite was 0.12%. The temperature at the continuous annealing stage for the strip steel was 750° C.; the hold time at the annealing stage was 40 s; the cooling rate in the annealing was 120° C./s; and the reduction rate of the double cold reduction for the strip steel was 5%. The mechanical performances of the final strip steel baked at 200° C. for 30 min: the yield strength Rp0.2 was 587 MPa; and the elongation at break was 7.8%.

COMPARATIVE EXAMPLE 4

The alloy composition of Comparative Example 4 was: C: 0.13%, Mn: 0.5%, Al: 0.05%, P: 0.015%, N: 0.005%, B: 0.003%, Cr: 0.02%, Ti: 0.005%, Cu: 0.01%. The features of the phase composition of the strip steel were: the zone of pearlite+martensite+cementite particles accounted for 21.6% by volume; the martensite zone accounted for 6.9% by volume; the grain size of ferrite was 8.4 μm; and the carbon solid solution content in martensite was 0.1%. The temperature at the continuous annealing stage for the strip steel was 820° C.; the hold time at the annealing stage was 40 s; the cooling rate in the annealing was 80° C./s; and the reduction rate of the double cold reduction for the strip steel was 10%. The mechanical performances of the final strip steel baked at 200° C. for 30 min: the yield strength Rp0.2 was 555.8 MPa; and the elongation at break was 10.2%.

COMPARATIVE EXAMPLE 5

The alloy composition of Comparative Example 5 was: C: 0.10%, Mn: 0.5%, Al: 0.05%, P: 0.015%, N: 0.02%, B: 0.003%, Cr: 0.10%, Ti: 0.2%, Cu: 0.01%. The features of the phase composition of the strip steel were: the zone of pearlite+martensite+cementite particles accounted for 4% by volume; the martensite zone accounted for 0.6% by volume; the grain size of ferrite was 5.2 μm; and the carbon solid solution content in martensite was 0.07%. The temperature at the continuous annealing stage for the strip steel was 750° C.; the hold time at the annealing stage was 20 s; the cooling rate in the annealing was 80° C./s; and the reduction rate of the double cold reduction for the strip steel was 2%. The mechanical performances of the final strip steel baked at 200° C. for 30 min: the yield strength Rp0.2 was 612.3 MPa; and the elongation at break was 5.9%.

COMPARATIVE EXAMPLE 6

The alloy composition of Comparative Example 6 was: C: 0.15%, Mn: 0.9%, Al: 0.05%, P: 0.015%, N: 0.01%, Cr: 0.10%, Ti: 0.2%, Nb: 0.3%. The features of the phase composition of the strip steel were: the pearlite zone accounted for 13% by volume; the martensite zone accounted for 0% by volume; and the grain size of ferrite was 7.6 μm. The temperature at the continuous annealing stage for the strip steel was 750° C.; the hold time at the annealing stage was 40 s; the cooling rate in the annealing was 30° C./s; and no double cold reduction was conducted. The mechanical performances of the final strip steel baked at 200° C. for 30 min: the yield strength Rp0.2 was 454.8 MPa; and the elongation at break was 20.8%.

TABLE 1

(unit: mass percentage)

| | C | Mn | Al | P | N | B | Cr | Ti | Nb | Cu | Mo |
|---|---|---|---|---|---|---|---|---|---|---|---|
| Ex. 1 | 0.081 | 0.5 | 0.05 | 0.015 | 0.005 | 0.001 | 0.02 | 0 | 0 | 0.01 | 0.001 |
| Ex. 2 | 0.081 | 0.5 | 0.05 | 0.01 | 0.005 | 0.003 | 0.05 | 0.005 | 0.2 | 0.01 | 0.005 |
| Ex. 3 | 0.135 | 0.2 | 0.05 | 0.01 | 0.005 | 0.003 | 0.005 | 0 | 0 | 0.03 | 0.005 |
| Ex. 4 | 0.14 | 0.5 | 0.01 | 0.015 | 0.015 | 0.003 | 0.02 | 0.1 | 0 | 0.01 | 0.008 |
| Ex. 5 | 0.10 | 0.8 | 0.035 | 0.015 | 0.015 | 0.005 | 0.02 | 0.001 | 0 | 0.01 | 0 |
| Ex. 6 | 0.10 | 0.5 | 0.09 | 0.03 | 0.005 | 0.003 | 0.02 | 0.005 | 0.001 | 0.005 | 0 |
| Ex. 7 | 0.10 | 0.5 | 0.09 | 0.03 | 0.002 | 0.003 | 0.02 | 0.005 | 0 | 0.01 | 0 |
| Ex. 8 | 0.10 | 0.5 | 0.05 | 0.015 | 0.005 | 0.003 | 0.02 | 0.005 | 0 | 0.01 | 0 |

TABLE 1-continued (unit: mass percentage)

| | C | Mn | Al | P | N | B | Cr | Ti | Nb | Cu | Mo |
|---|---|---|---|---|---|---|---|---|---|---|---|
| Comp. Ex. 1 | 0.07 | 0.5 | 0.09 | 0.03 | 0.002 | 0.003 | 0.02 | 0.005 | 0 | 0.04 | 0 |
| Comp. Ex. 2 | 0.10 | 0.1 | 0.05 | 0.008 | 0.005 | 0.01 | 0.02 | 0.005 | 0 | 0.01 | 0 |
| Comp. Ex. 3 | 0.10 | 0.5 | 0.005 | 0.05 | 0.002 | 0.003 | 0.02 | 0.005 | 0 | 0.01 | 0.01 |
| Comp. Ex. 4 | 0.13 | 0.5 | 0.05 | 0.015 | 0.005 | 0.003 | 0.02 | 0.005 | 0 | 0.01 | 0 |
| Comp. Ex. 5 | 0.10 | 0.5 | 0.05 | 0.015 | 0.020 | 0.003 | 0.10 | 0.2 | 0 | 0.01 | 0 |
| Comp. Ex. 6 | 0.15 | 0.9 | 0.05 | 0.015 | 0.01 | 0 | 0.10 | 0.2 | 0.3 | 0 | 0 |

TABLE 2

| | Phase Features | | | | Production Process | | | |
|---|---|---|---|---|---|---|---|---|
| | Pearlite + martensite + cementite particles (%) | Martensite (%) | Ferrite grain size (μm) | C solid solution content in martensite (%) | Continuous annealing temperature (° C.) | Hold time in annealing (s) | Cooling rate in annealing (° C./s) | Reduction rate of double cold reduction (%) |
| Ex. 1 | 10 | 2 | 6.5 | 0.082 | 720 | 40 | 60 | 10 |
| Ex. 2 | 13 | 4 | 6.5 | 0.095 | 750 | 40 | 90 | 5 |
| Ex. 3 | 5 | 1.2 | 5.3 | 0.071 | 705 | 30 | 50 | 5 |
| Ex. 4 | 19.0 | 4.8 | 6.2 | 0.1 | 800 | 30 | 90 | 18 |
| Ex. 5 | 14 | 1.5 | 6.8 | 0.081 | 750 | 50 | 50 | 10 |
| Ex. 6 | 5 | 2.5 | 5.5 | 0.090 | 700 | 30 | 90 | 12 |
| Ex. 7 | 14 | 3.5 | 6.2 | 0.089 | 750 | 40 | 80 | 10 |
| Ex. 8 | 19.0 | 1.2 | 6.7 | 0.080 | 800 | 30 | 50 | 5 |
| Comp. Ex. 1 | 0 | 0 | 5.2 | — | 690 | 40 | 50 | 19 |
| Comp. Ex. 2 | 12 | 3.2 | 8.2 | 0.068 | 750 | 60 | 50 | 10 |
| Comp. Ex. 3 | 14 | 7.8 | 5.7 | 0.12 | 750 | 40 | 120 | 5 |
| Comp. Ex. 4 | 21.6 | 6.9 | 8.4 | 0.10 | 820 | 40 | 80 | 10 |
| Comp. Ex. 5 | 4 | 0.6 | 5.2 | 0.070 | 750 | 20 | 80 | 2 |
| Comp. Ex. 6 | 13 | 0 | 7.6 | — | 750 | 40 | 30 | 0 |

TABLE 3

| | Rp0.2(MPa) | A(%) |
|---|---|---|
| Ex. 1 | 564 | 18 |
| Ex. 2 | 512 | 20.9 |
| Ex. 3 | 482 | 20.2 |
| Ex. 4 | 650 | 5.5 |
| Ex. 5 | 544 | 15 |
| Ex. 6 | 597 | 13 |
| Ex. 7 | 575 | 17 |
| Ex. 8 | 497 | 20.3 |
| Comp. Ex. 1 | 645 | 0.5 |
| Comp. Ex. 2 | 501.3 | 8 |
| Comp. Ex. 3 | 587 | 7.8 |
| Comp. Ex. 4 | 555.8 | 10.2 |
| Comp. Ex. 5 | 612.3 | 5.9 |
| Comp. Ex. 6 | 454.8 | 20.8 |

The invention claimed is:

1. A multiphase steel tinned raw plate, having a chemical composition consisting of, by mass percentage, C: 0.081-0.14%, Mn: 0.2-0.8%, Al: 0.01-0.09%, P: 0.01-0.03%, N: 0.002-0.015%, Cu: 0.005-0.03%, one or more elements selected from the group consisting of B: 0.001-0.005%, Cr: 0.005-0.05%, Ti: 0.001-0.1%, Nb: 0.001-0.2%, and Mo: 0.001-0.008%, and a balance of Fe and unavoidable impurities, wherein the following relationship is met: 0.21%≤Mn+1.3Cr+3.2Mo+0.5Cu≤0.91%, wherein the multiphase steel tinned raw plate has a structure consisting of ferrite grains, pearlite, martensite and cementite particles, wherein the pearlite, martensite, and cementite particles in the structure of the multiphase steel tinned raw plate have a volume fraction of 5-20%, and the martensite in the structure of the multiphase steel tinned raw plate has a volume fraction of equal to or higher than 1% to less than 5%; and wherein, after baking at 150-300° C. for 15-60 min, the multiphase steel tinned raw plate has a yield strength Rp0.2≥(400+12×DCR)MPa, and an elongation A≥(25−1.2×DCR) %, wherein DCR represents a reduction rate of double cold reduction, wherein 5%≤DCR≤18%.

2. The multiphase steel tinned raw plate of claim 1, wherein the ferrite in the structure of the multiphase steel tinned raw plate has a grain size of ≤7 μm.

3. The multiphase steel tinned raw plate of claim 1, wherein the martensite in the structure of the multiphase steel tinned raw plate has a carbon solid solution content of ≥0.07%.

4. The multiphase steel tinned raw plate of claim 1, wherein the content of N is 0.005-0.015%.

5. The multiphase steel tinned raw plate of claim 1, wherein the martensite in the structure of the multiphase steel tinned raw plate has a volume fraction of 1% to 4.8%.

6. The multiphase steel tinned raw plate of claim 2, wherein the martensite in the structure of the multiphase steel tinned raw plate has a carbon solid solution content of ≥0.07%.

7. A method for manufacturing the multiphase steel tinned raw plate of claim 1, wherein the tinned raw plate has a chemical composition consisting of, by mass percentage, C: 0.081-0.14%, Mn: 0.2-0.8%, Al: 0.01-0.09%, P: 0.01-0.03%, N: 0.002-0.015%, Cu: 0.005-0.03%, one or more elements selected from the group consisting of B: 0.001-0.005%, Cr: 0.005-0.05%, Ti: 0.001-0.1%, Nb: 0.001-0.2%, and Mo: 0.001-0.008%, and a balance of Fe and unavoidable impurities, wherein the following relationship is met: 0.21%≤Mn+1.3Cr+3.2Mo+0.5Cu≤0.91%, wherein the tinned raw plate is subjected to continuous annealing and double cold reduction in sequence, wherein a temperature T in the continuous annealing stage is (727−100×C−30×Mn−1000×N)° 800° C.; a holding time is 30 s-50 s; a cooling rate in a zone having a temperature of 250° C. or higher is 50-90° C./s; wherein a reduction rate of the double cold reduction DCR is 5%≤DCR≤18%.

8. The method of claim 7 for manufacturing the multiphase steel tinned raw plate, wherein production steps prior to the continuous annealing of the tinned raw plate include smelting, hot rolling, pickling and single cold reduction.

9. The method of claim 7 for manufacturing the multiphase steel tinned raw plate, wherein: the ferrite has a grain size of ≤7 μm.

10. The method of claim 7 for manufacturing the multiphase steel tinned raw plate, wherein the martensite in the structure of the multiphase steel tinned raw plate has a carbon solid solution content of ≥0.07%.

11. The method of claim 7 for manufacturing the multiphase steel tinned raw plate, wherein the content of N is 0.005-0.015%.

12. The method of claim 7 for manufacturing the multiphase steel tinned raw plate, wherein the martensite in the structure of the multiphase steel tinned raw plate has a volume fraction of 1% to 4.8%.

* * * * *